United States Patent [19]

Okumoto

[11] 4,036,238

[45] July 19, 1977

[54] APPARATUS FOR CONTROLLING AMOUNT OF TOBACCO FILLER IN CIGARETTE MANUFACTURING MACHINE

[75] Inventor: Yutaka Okumoto, Oyama Higashi, Japan

[73] Assignee: The Japan Tobacco & Salt Public Corporation, Tokyo, Japan

[21] Appl. No.: 656,893

[22] Filed: Feb. 10, 1976

[30] Foreign Application Priority Data

Feb. 10, 1975 Japan ..... 50-16327

[51] Int. Cl.[2] ..... A24C 5/34

[52] U.S. Cl. ..... 131/21 B; 131/21 D

[58] Field of Search ..... 131/21 D, 21 E, 21 R, 131/21 B, 21 A

[56] References Cited

U.S. PATENT DOCUMENTS

| | | | |
|---|---|---|---|
| 3,288,147 | 11/1966 | Molins et al. | 131/21 D |
| 3,306,304 | 2/1967 | Molins et al. | 131/21 D |
| 3,504,679 | 4/1970 | Lowman | 131/21 D |
| 3,595,067 | 7/1971 | Von der Lohe et al. | 131/21 B |
| 3,738,376 | 6/1973 | Labbe et al. | 131/21 D X |

*Primary Examiner*—Stephen C. Pellegrino
*Attorney, Agent, or Firm*—Armstrong, Nikaido & Marmelstein

[57] ABSTRACT

An apparatus for controlling an amount or mass per unit length of a tobacco filler in a cigarette manufacturing machine by utilizing the interrelation between a characteristic of the tobacco filler, for example air-permeation, radiation ray-permeation or the like and the amount or mass of the tobacco filler. Variations in the characteristic are detected and converted into an electrical signal, which is then applied to a fluid pressure distributing means to impart up and down movement to a trimming means through a piston means thereby to remove surplus tobacco from the filler. The quantity of the movement or a displacement of the trimming means is converted into an electrical signal, which is then fed back through an electrohydraulic servo mechanism to regulate the operation of the trimming means. Accordingly, variations in uniformity of the filler can be reduced at a very high response speed through one control mechanism with a simple structure.

8 Claims, 10 Drawing Figures

APPARATUS FOR CONTROLLING AMOUNT OF TOBACCO FILLER IN CIGARETTE MANUFACTURING MACHINE

The present invention concerns improvements in or relating to an apparatus for controlling or maintaining an amount of a tobacco filler in a cigarette manufacturing machine to be a fixed value at a remarkably high response rate as compared with that in conventional method, and assuring a desired average weight and a uniform mass of the tobacco filler.

It is desirable that individual cigarettes have substantially the same weight and a uniform mass per unit length to tobacco filler.

At present, however, in practice, there is unevenness in the mass per unit length of the filler, and cigarette manufacturers have made utmost efforts to minimize the unevenness.

It is practically difficult to weigh the cigarettes one by one and, therefore, other characteristics having interrelationship with mass are used for measuring the mass per unit length of the tobacco filler.

One of the characteristics widely employed is a radiant ray, especially beta radiation from strontium 90. When a source of the beta radiation and an ion chamber are positioned on opposite sides of a rod cigarette, and only the beta rays that have penetrated the rod cigarette are made to enter the ion chamber by using a specially devised apparatus having, for example, a covering means, an output current from the ion chamber varies substantially in proportion to a change in the amount of the tobacco filler. The current is passed across a resistance of relatively high value to develop a voltage and said voltage together with a voltage obtained across a resistance of relatively high value from an output current of a dummy ion chamber provided for compensating variations in the ion chamber is amplified in an amplifier, whereby it is detected whether a mass per unit length of tobacco filler in comparison with the standard mass is greater or less by converting the mass to the voltage. Upon detection, the filler is trimmed to have a desired mass, and such cigarettes as have too small mass per unit length to satisfy smokers can be removed.

An apparatus for controlling the amount of tobacco filler of the kind has already been used in the field and in such an apparatus the voltage thus amplified and converted from the mass per unit length of the filler is transmitted to distinction means. When the voltage deviates a predetermined limit value, a trimming device is moved up or down by a motor thereby to obtain the desired mass per unit length of the filler.

The above conventional apparatus is as detailedly disclosed in, for example, Japanese Patent Application Publication No. 38-15949, in which in order to corect the mass per unit length of the filler thus detected to obtain a desired value the trimming device is moved up and down through a link mechanism by rotation of a screw provided at a wormwheel driven by a motor through a worm.

In such an apparatus as briefly explained above, the time required for correction of the amount of the tobacco filler is mechanically restricted and there is caused such a disadvantage that the uneveness in the filler amount is not sufficiently minimized and that since the motor rotates at a uniform speed irrespectively of the value to be corrected, when the wormwheel rotates at a high speed for removal of a small amount of the filler, the trimming for correction is carried out more than needed and the purpose can not be attained. Accordingly, the wormwheel is required to rotate at a low speed. Assuming that the amount of the filler to be removed is large and the wormwheel rotates at a low speed, it takes much time to complete the correcting operation. Therefore it is difficult to minimize the unevenness in the mass per unit length of the tobacco filler which is conveyed at a very high speed.

Thus, in a cigarette manufacturing machine which is required to work with increasing speed, the time for correcting the amount of the filler is an important issue, and it has be eagerly desired to regulate the operation of the trimming device more speedily with less correction time. In this connection, it should be noted that in an apparatus utilizing an electrical control system, the response rate is greatly influenced by the arrangements of electrical circuits.

The present invention has been made to overcome the above disadvantages, and a primary object of the present invention is to provide an improved apparatus for controlling the amount of tobacco filler comprising a trimming device, wherein the radiant ray-permeation of the filler is converted into an electrical signal through an ion chamber to vertically move the trimming device, while the quantity of the up and down movement of the trimming device is also converted into an electrical signal which is fed back thereby to rapidly position the trimming device at a desired level in a stable manner; and further, through an electrohydrualic servo mechanism, a valve of a fluid pressure distributing means is actuated by the above electrical current and the fluid pressure is amplified to impart a sufficient force to the trimming device to move up and down through a piston means whereby the surplus amount of tobacco filler is accurately detected and trimmed out thus to improve the uniformity in the amount of the tobacco filler.

According to the present invention there is provided an apparatus for controlling an amount of a tobacco filler as it is conveyed by a conveyor in a cigarette manufacturing machine, comprising a means for detecting an amount of a tobacco filler and transmitting an electrical signal corresponding to the amount, an electrical servo valve operative in response to said electrical signal, a piston means actuated by said electrical servo valve, a trimming means adapted to move through the movement of said piston means and a negative feed back means for feeding back an electrical signal corresponding to a displacement of the trimming means to the electrical servo valve to control the movement of the piston means.

The present invention will be better understood from the following description taken in connection with the accompanying drawings in which.

Figure 1:
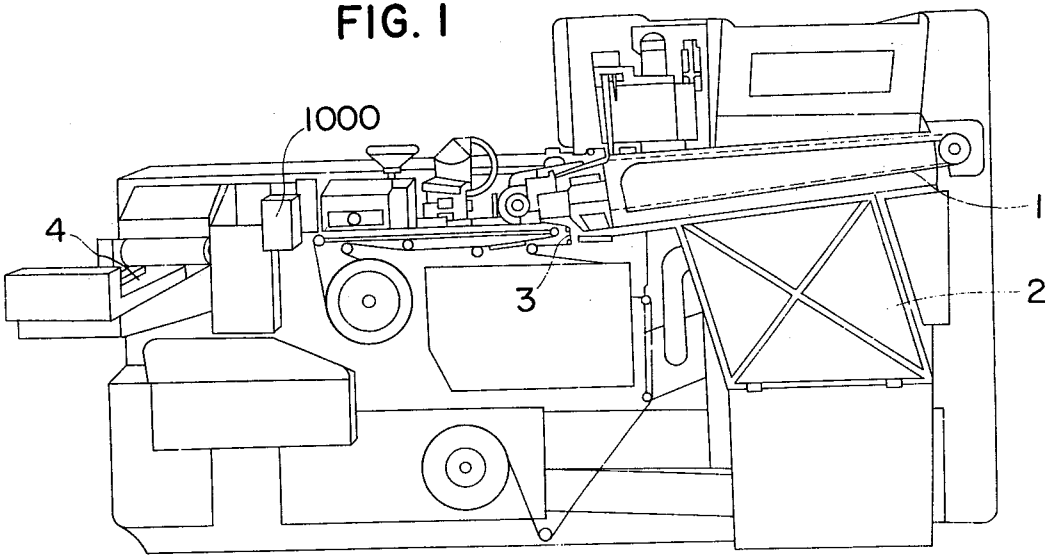
FIG. 1 is a front elevation of a continuous rod cigarette manufacturing machine provided with an apparatus in accordance with the invention.

Referring now to FIG. 1, cut tobacco to conveyed upwardly by air flowing through a narrow passage 2 to a preforated conveyor band 1 made of metal. The cut tobacco thus conveyed is sucked up and held beneath the conveyor band 1 to form a flow of continuous tobacco or a filler which is carried by said conveyor band from right to left as viewed in FIG. 1. When the tobacco flow or the tobacco filler has gone beyond the passage 2, it is subjected to a trimming treatment to remove off surplus tobacco thereby to reduce variations of the uniformity in the tobacco filler. With such operation, continuous trimmed tobacco filler is obtained.

The trimmed filler is transferred from the conveyor band 2 onto a continuous rolled cigarette paper 3. After the filler has passed under a compression tongue, the filler is wrapped up in the paper to form a continuous rod of cigarette. The rod cigarette passes through a detecting means 1000 where the cigarette is irradiated with beta rays and the mass per unit length of the cigarette is measured by detecting the permeation of the beta rays at an ion chamber. The rod cigarette is then cut into individual pieces having a proper length by means of a customary cutting machine, which pieces are then collected on a catcher band 4.

Figure 2:
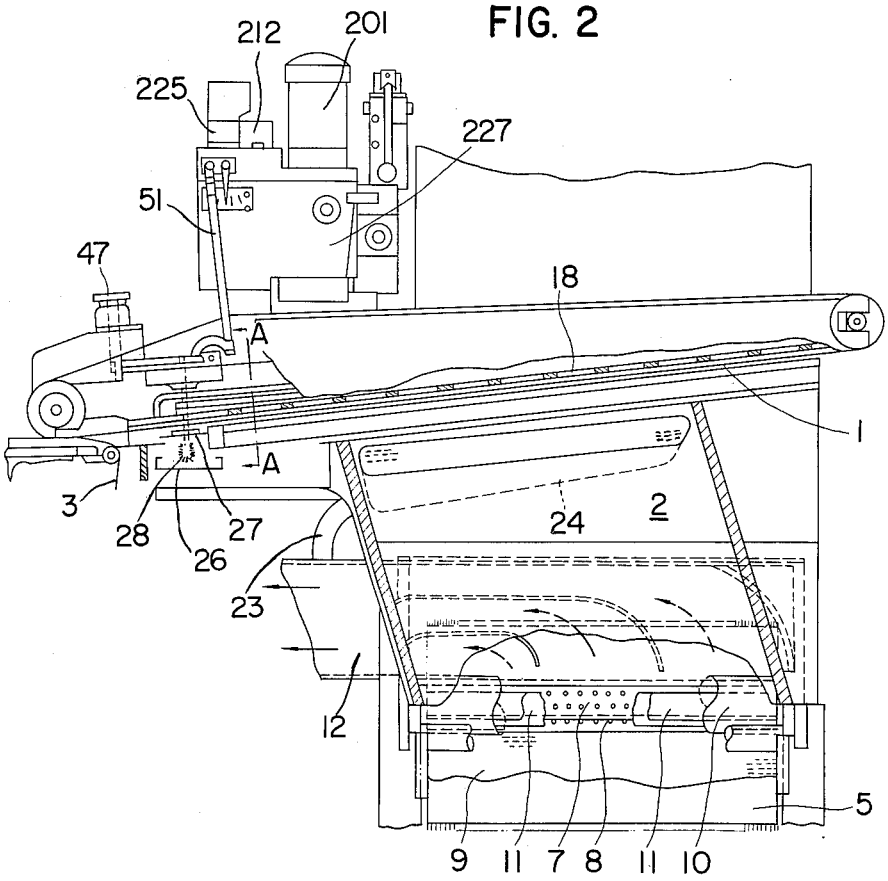
FIG. 2 is a sectional view of a part of the machine shown in FIG. 1, with other parts broken away.

FIG. 2 more detailedly shows a means for feeding tobacco to the conveyor band 1. The tobacco is fed through a brushing roller (not shown) on to the upper surface of a carding drum 5 which carries the tobacco.

The tobacco is then picked up and thrown forwardly by a push-up roller 7, which further pushes up the tobacco over a guide plate 8 towards the entrance to the passage 2. The air is made to flow through a lattice 9 towards the passage 2, and flow upwardly through a fixed element 11 and a perforated rotary cylinder 10. The air is made to flow through the rotary cylinder 10 and a conduit 12 by means of a suction fan (not shown) and discharged into a diffuse chamber (not shown), from which the air flows upwardly through the lattice 9.

Further, the air is flown through the passage 2 and a suction chamber 18 by means of another suction fan (not shown) and is discharged to atmosphere through a multi-unit cyclone (not shown) by which dust is separated from the air. A pipe 23 connects the conduit 12 with the passage 2 through a suction chamber 24 and a lattice in the passage 2. A part of the air flowing through the passage is discharged before it reaches the conveyor band 1.

With such structure as explained above, the tobacco thus pushed out by the push-up roller 7 reaches the conveyor band 1 on the flow of the air, during which the particles of the tobacco are adequately separated.

The tobacco is fed to the conveyor band 1 with an excess amount of the tobacco filler. The surplus tobacco is removed by the regulating operation as mentioned hereinbefore. The tobacco filler as originally made (containing the surplus tobacco) has non-uniform amounts of tobacco in relation to its length. Therefore, the purpose of the trimming operation is to trim out the surplus tobacco to reduce the thickness or the cross-sectional area of the tobacco filler, thereby achieving uniformity of the tobacco filler.

Now, referring to FIG. 2, a trimming device 26 comprises a pair of rotating discs 27 which are mounted adjustably at a suitable level lower than that of the conveyor band 1. A brush 28 is provided beneath the discs 27 and adapted to facilitate the removal of the tobacco between the discs and the brush thereby facilitating the trimming operation. The arrangement and mounting of the trimming device will be explained hereinbelow referring to FIGS. 4, 5 and 6.

Figure 4:
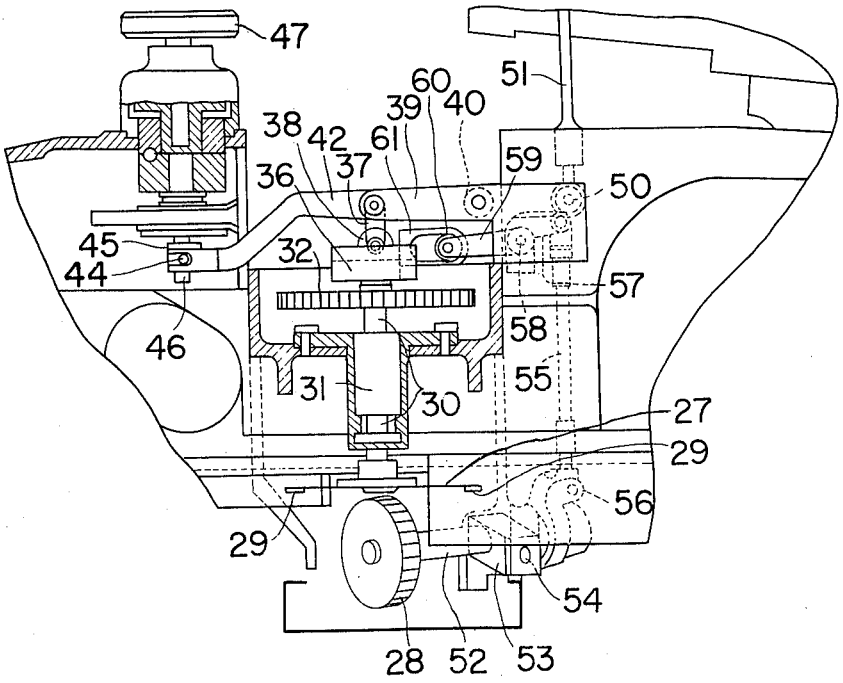
FIG. 4 is a view, partly in section illustrating a trimming device and its mounting employed in an apparatus according to the present invention.
Figure 6:
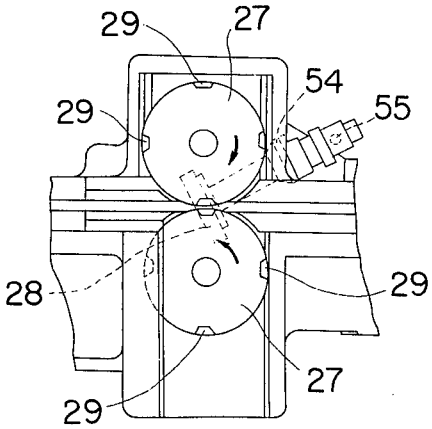
FIG. 6 is a plan view of a lower part of the device shown in FIG. 4.

As shown in FIGS. 4 and 6, each of the discs 27 has four equi-spaced downwardly recessed portions at its circumferential edge. When both discs rotates and a pair of said recessed portions meet as shown in FIG. 6, the amount of the tobacco filler to be removed will be less than that to be removed when other plain (not-recessed) portions of the discs meet. As a result, when the filler is compressed to a predetermined size and is cut into a cigarette length, those portions at which the rod cigarette is cut has more densed tobacco than intermediate portions. Accordingly, the final cigarette thus produced may have both ends having more densed filler than intermediate portion.

Figure 5:
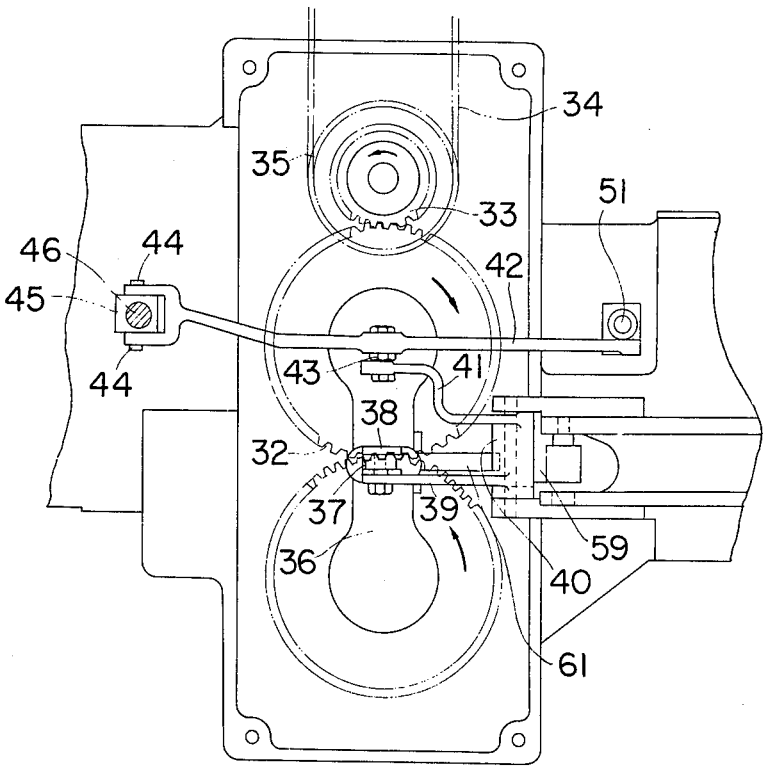
FIG. 5 is a plan view of a part of the device shown in FIG. 4.

Referring to FIG. 4, the discs 27 are fixed to the ends of a vertical rods 30 which are slidable up and down and rotatable by means of bearings in a sleeve 31. Near the upper ends of the rods 30 are fixedly provided a pair of toothed wheels 32 as shown in FIGS. 4 and 5. One of the toothed wheels is driven by a toothed wheel 33 in FIG. 5. A belt pulley 35 fixed to the toothed wheel 33 is driven by a belt 34.

The upper ends of the rods 30 are rotatably supported with bearings at both ends of a yoke 36. Accordingly said yoke 36 supports the discs 27. The yoke 36 is supported by a link 37, which is pivotally connected at one end to projection 38 on the yoke 36 and is pivotally connected at its other end on a level 39 formed on a rotatable sleeve 40. As can be seen from FIG. 5, another lever 41 extends from the above sleeve 40. The free end of the lever 41 is pivotally connected to a long lever 42 by a pin 43, substantially midway along the length of the lever 42.

As is shown in FIGS. 4 and 5, the left-hand end of the lever 42 is forked into two branches, the ends of which have slots to receive a projection 44 extending from a block 45. Said block 45 has an thread opening to receive a screw 46, which is adapted to rotate in one direction or the other direction in order to raise or lower the end of the lever 42 according to necessity. The screw 46 is rotated by turning a knurled handle 47. The other end of the lever 42 is pivotally connected to the lower-most end 50 of a downwardly extending control stick 51. The control stick 51 is arranged to move vertically as will be explained hereinafter. The position or level of the discs 27, to wit, the distance between the conveyor band 1 and the discs 27 is controlled by the stick 51.

The brush 28 is mounted on a shaft 52 in FIG. 4 and is rotated by a belt-pulley device (not shown). The brush 28 is adapted to move up and down together with the discs 27. Illustratively stated, the shaft 52 is journalled in a block 53 and is arranged to swing about a pivot 54 by a rod 55 pivotally connected to an extension 56. The rod 55 is moved up and down through a lever 57 fixed on a shaft 58 on which a lever 59 is also fixed. A roller 60 on the free end of the lever 59 is put in a slot formed in an extension 61 fixed to the yoke 36. Accordingly, the up and down movement of the yoke to raise or lower the discs makes the brush 28 move up and down through the link mechanism as explained above. The above device and mechanism are more detailedly described in Japanese Patent Application Publication No. 38-15949.

Figure 3:
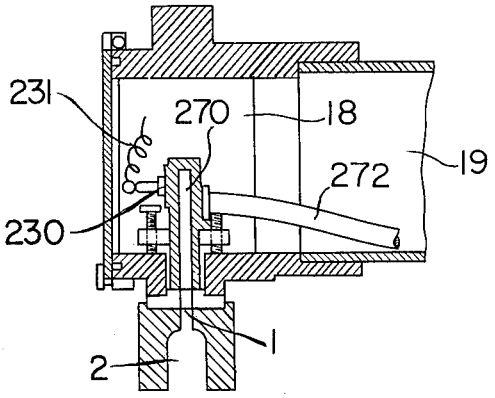
FIG. 3 is a section taken along the line A — A in FIG. 2.

Referring to FIGS. 2 and 3, downstream of the passage 2 and near the trimming device 26, a small air chamber 270 is provided inside a suction chamber 18. As can be seen from FIG. 3, the chamber 270 has an opening adjacent the porous conveyor band 1. The width of the chamber as well as of the opening is substantially equal to that of the conveyor band 1, and the length of the opening is substantially equal to that of one cigarette. A pipe 272 communicating with the interior of the chamber 270 through one side thereof extends into a conduit 19 which is a main exhaust pipe for the suction chamber 18. With such a construction as explained, air is drawn through the conveyor band 1, the small chamber 270 and the pipe 272 at another portion along the conveyor band 1 independently of the air stream flowing through the conveyor band 1 and the suction chamber 18.

As mentioned above, the small air chamber 270 constitutes an independent air-tight chamber. To the other side of the air chamber is fixed a semiconductive pressure transducer 230, through which an electrical signal corresponding to an air pressure in the chamber 270 is taken out, which signal is then fed to a pressure signal input terminal in a controlling circuit through a cord 231.

Figure 7:
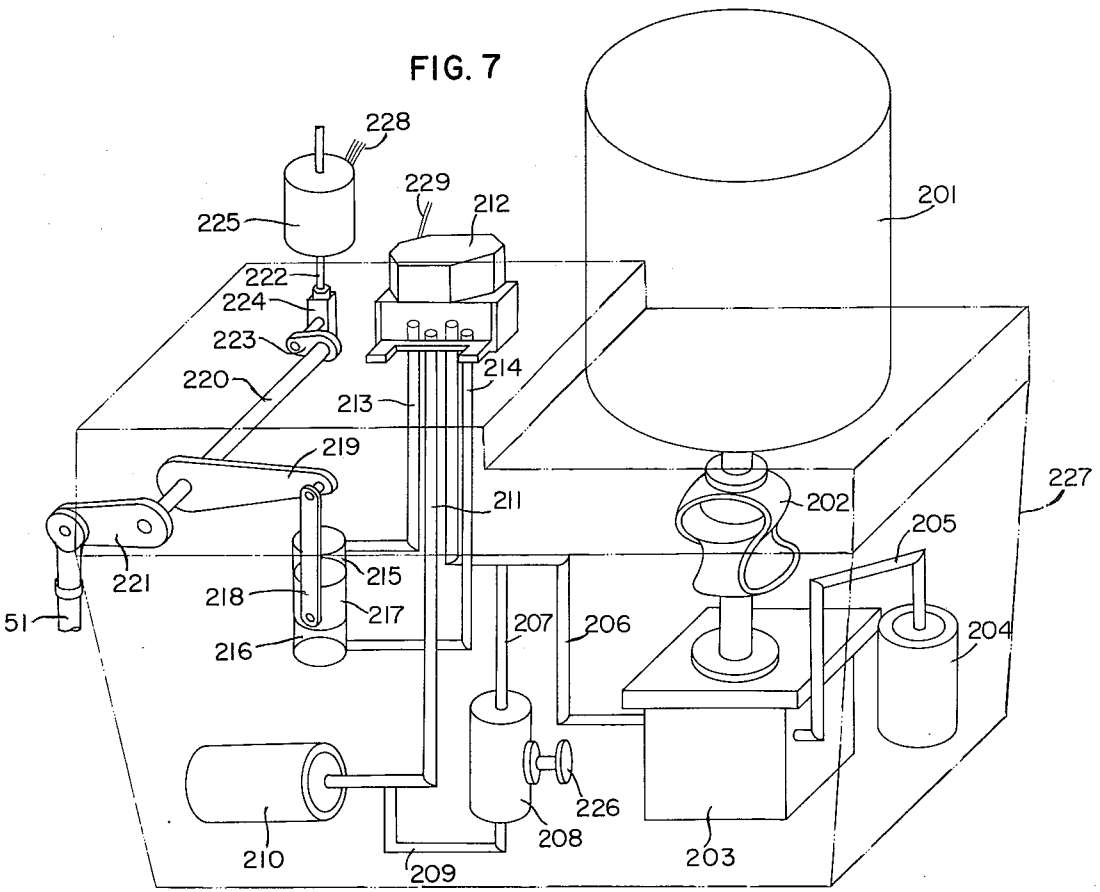
FIG. 7 is a diagrammatical view of a fluid pressure amplifying system employed in an apparatus according to the present invention.

An output signal from the above controlling circuit is, as shown in FIG. 7, fed to an electrohydraulic servo valve 212 through a cord 229. The electrohydraulic servo valve 212 forms an oil pressure distributing means in an oil pressure amplifier as will be explained hereinafter. The oil pressure amplifier has such a construction that a slight variation of the air pressure in the air chamber 270 may be translated to a piston means 217 in order to impart a sufficient force to the control stick 51 to move in the vertical direction according to the lengthwise movement of the stick 51. With the stick 51, one end of the lever 42 which supports the discs 27 is moved upwards or downwards. Accordingly, the movement of said one end of the lever 42 indicates the density of the tobacco filler in the form of a characteristic such as the airflow through the filler, namely it is moved in accordance with the variations in the characteristic represented by air pressure in the chamber 270.

FIG. 7 shows an oil pressure amplifier means, which comprises an oil pressure unit of a gear pump 203 driven by a motor 201 through a coupling 202. The main part of the oil pressure unit is contained in a tank 227 partially filled with oil, and there is provided a hydraulic system in which the piston 217 is actuated through the gear pump 203 and the electrohydraulic servo valve 212. Oil is sucked up into the gear pump 203 through a filter 204, and reaches the servo valve 212 through a pipe 206. The electrohydraulic servo valve 212 works in response to a controlling current from a controlling circuit (FIG. 8) to distribute the high pressure oil from the gear pump either to a pipe 213 or to a pipe 214 thereby to press down or up a piston 217, respectively. The servo valve 212 may be controlled by electrical signals which have been controlled in response to the variations in the air pressure in the chamber 270.

More detailedly illustrated, referring to FIG. 7, the piston 217 is slidably provided in a cylinder fixed to the tank 227. When an oil pressure is applied to a cylinder room 215 through the pipe 213, the piston 217 is pressed down, while oil in a cylinder room 216 is discharged into the tank 227 through the pipe 214 and a return pipe 211. Similarly, when an oil pressure is applied to the cylinder room 216 through the pipe 214, the piston 217 is pressed up and oil in the cylinder room 215 is discharged into the tank 227 through the pipe 213 and the return pipe 211 which is provided with a filter 210 at its outlet portion.

In the hydraulic system as described above, the oil pressure is maintained at a fixed level. When an oil pressure having a level over the predetermined one is applied through the gear pump, the oil is adapted to overflow into the outer tank through a return pipe 209 and the filter 210 by actuating a relief valve 208 through a pipe 207 which is branched from a pipe 206 substantially midway between the gear pumps 203 and the electrohydraulic servo valve 212. The oil pressure in the hydraulic system is set at a desired level by adjusting an pressure control screw 226.

The up and down movement of the piston 217 is transmitted to a connecting rod 218 which is pivotally connected at its one end to the piston 217. The other end of the connecting rod 218 is pivotally connected to an arm 219. The up and down movement of the piston 217 transmits a swinging motion to the arm 219, which is fixed to a shaft 220 pivotally supported at the tank 227. The rotational motion of the shaft 220 is transmitted to an arm 221 fixed at its one end to one end of the shaft 220 thereby to move lengthwise the control stick 51 which is pivotally connected to the other end of the arm 221. The trimming discs 27 move up and down through the movement of the control stick 51 as explained hereinbefore.

At the other end of the shaft 220 is fixed an arm 223 which is adapted to rotatably swing through the rotational motion of the shaft 220. A link 224 is fixed to the arm 223 to move up and down in accordance with the motion of the link 224. To the link 224 is fixed an axis core 222 of a differential transformer 225, which extends upwardly from the link 224 and also moves up and down by the rocking motion of the link 224. The differential transformer 225 may have such a structure that when the axis core moves upwards, a positive voltage is generated, for example, in proportion to a displacement of the axis core; while a negative voltage is built up in the downward movement of the link. In the present embodiment, when the control stick 51 is raised, a positive voltage is detected at the differential transformer 225; and when the stick 51 is lowered, a negative voltage is detected.

The variations in the pressure of the air traversing the tobacco filler are detected at the air chamber 270 and converted into an electrical signal at the semiconductive pressure transducer 230. Said electrical signal and an electrical signal from the differential transformer 225 are to be applied to the electrohydraulic servo valve 212. In this embodiment, when the filler below the conveyor band 1 has a high density, the pressure in the chamber 270 is low, a voltage from the semiconductive pressure transducer 230 goes negative, the electrical oil pressure servo valve 212 delivers oil pressure to the cylinder room 215, the control stick 51 together with the discs 27 moves up, and the axis core 222 of the differential transformer 225 also moves up to give a positive voltage. By said positive voltage, the servo valve 212 delivers oil pressure to the cylinder room 216 to move the control stick 51 downwards. Thus till the voltage to be applied on the servo valve 212 reaches 0 (zero), the stick 51 moves up. In the same way, the filler below the conveyor band 1 has a low density, the pressure in the air chamber 270 is high, the voltage from the semiconductive pressure transducer 230 goes positive, and oil pressure is transmitted to the cylinder room 216 through the servo valve 212 thereby to actuate the control stick 51 to move downwards, while the differential transformer develops a negative voltage to apply the oil pressure to the cylinder room 215 through the servo valve 212 thereby to raise the stick 51. The control stick 51 is lowered to the extent that the voltage to be applied on the servo valve 212 reaches zero. In this way, the position or height of the trimming discs 27 is adjusted in response to the variations in the density of the tobacco filler and in proportion to the variations in the pressure in the air chamber 270.

As explained above, in the present apparatus there is provided such a control means that in case the tobacco filler at the conveyor band 1 is in its normal state, the output from the semiconductive pressure transducer 230 produced from the air pressure in the chamber 270 and the level of the trimming discs 27 or the output from the differential transformer 225 may reach zero.

In this connection, it is necessary to provide a control circuit and an actuating mechanism which are capable of responding surely and rapidly to the output signals from the semiconductive pressure transducer 230 and the differential transformer 225. As to the actuating mechanism there has been given a detailed explanation referring to the oil pressure amplifying system. A preferred example of the control circuit for said oil pressure amplifying system will be illustrated hereinbelow.

Figure 8:
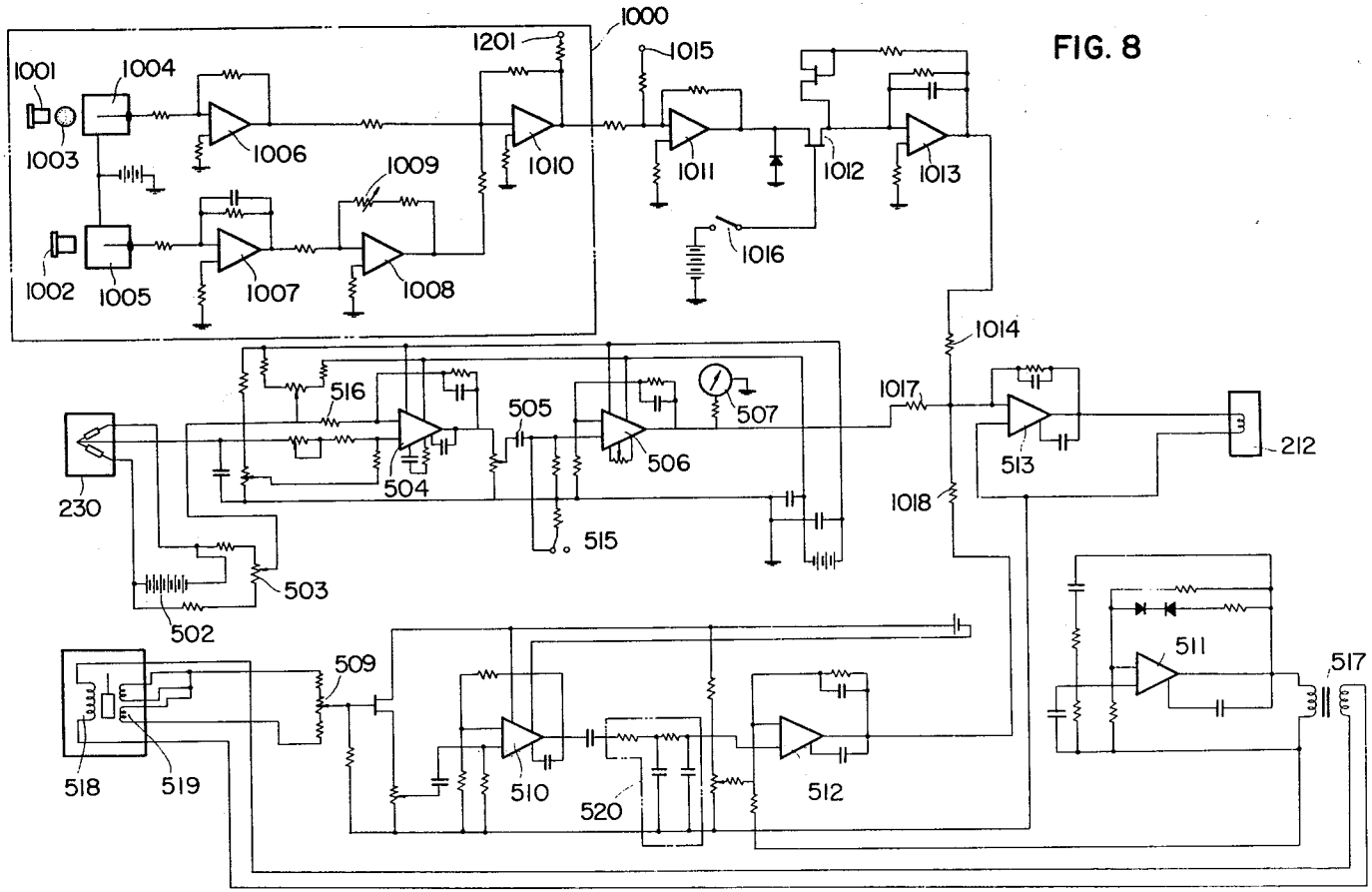
FIGS. 8 and 9 are controlling circuit diagrams.

The whole circuit as shown in FIG. 8 forms a part of the present apparatus. The semiconductive pressure transducer 230 adapted to take out the changes in the pressure in the air chamber 270 constitutes half of a bridge circuit. A proper D.C. power source 502 is applied while varying a resistance value of a variable registor 503 so as to give an output from the bridge circuit at substantially zero volt. The obtained signal is amplified in an amplifier 504 across a registor 516 and further fed to an amplifier 506 through a condenser 505. In this instance, the quantity of electricity charged on the condenser 505 can be rapidly reduced to zero according to necessity, especially at the start of the operation of the machine by actuating a switching means 515. The signal amplified in the amplifier 506 is visually indicated by a meter 507, while it is transmitted to a main amplifier 513 through a registance 1017, where it is properly amplified. Said signal is further fed to the electrohydraulic servo valve 212, thereby to move the piston 217 up and down and to give rotative swinging motion to the arm 219 and the shaft 220 in such a manner as previously described. In accordance with the movement of the shaft 220, the axis core 222 of the differential transformer 225 also moves up and down. Now, if an alternating current having a frequency of about 5 KHz from an oscillator amplifier 511 has been furnished as a bias to a primary coil 518 of the differential transformer 225 through a coil 517, the quantity of the swinging motion of the arm 219 with the shaft 220 is detected in the form of a difference between the voltages at both ends of secondary coil 519. The amount of the variation is detected by comparison with the standard value through a variable registor 509, and the signal thus obtained is amplified in an amplifier 510, high frequency portions or noises of which are removed through a filter 520, and further amplified in an amplifier 512 and then fed back to the main amplifier 513.

On the other hand, there is provided a detecting means 1000 to detect a mass per unit length of a rod cigarette before a cutting machine for cutting the rod cigarette into individual pieces of a predetermined length.

The detecting means 1000 has such an arrangement as follows. Beta rays from a beta ray source 1001 (strontium 90 in this embodiment) is made to penetrate a rod cigarette 1003 and to enter an ion chamber 1004. The permeation of beta rays is detected and a corresponding signal transmitted at this instance is amplified in an amplifier 1006 having high input impedance. While, beta rays from another radiant ray source 1002 are made to enter an ion chamber 1005 to transmit a signal, which signal is amplified in an amplifier 1007 having high input impedance and is further amplified in an amplifier 1008 where the gain may be varied by varying resistance value of a variable resistor 1009. Thus, the current signal from the ion chamber 1004 is added to the current signal from the ion chamber 1005, and is further amplified in an amplifier 1010 and, together with a voltage applied to a terminal 1015, is amplified in an amplifier 1011. By the operation of a switching means 1016, a transistor 1012 is made to open or close, and the signal is amplified or integrated at an amplifier 1013 and given to the main amplifier 513 across a resistance 1014.

Assuming now that a mass per unit length of a rod cigarette is small, more beta rays will enter the ion chamber 1004, an output from the ion chamber is negative-going, an output from the amplifier 1006 is positive-going, an output from the amplifier 1010 is negative-going, an output from the amplifier 1011 is positive going, an output from the amplifier 1013 is gradually reduced and then an output from the main amplifier 513 is gradually increased. Therefore, as explained before, the piston 217 is raised by the servo valve 212 and the discs 27 are lowered through the arm 221 thereby to increase an amount per unit length of the filler.

When the mass per unit length is large, the above polarity is reversed and the amount per unit length of the filler is decreased. Thus, the amount of the cigarette is always kept at a fixed one.

Though in the above embodiment, radiant rays are applied to a cigarette already formed into a rod, it is suggested that the detecting means 1000 should be located adjacent the discs 27 to detect the amount of the tobacco filler before the filler is wrapped with paper in order to further increase the response rate. But in such a case there is a problem that when the beta rays are applied to the cut tobacco adhered to the conveyor band 1, the quantity of the beta rays which leak out is larger than that which penetrate the cut tobacco.

Figure 10:
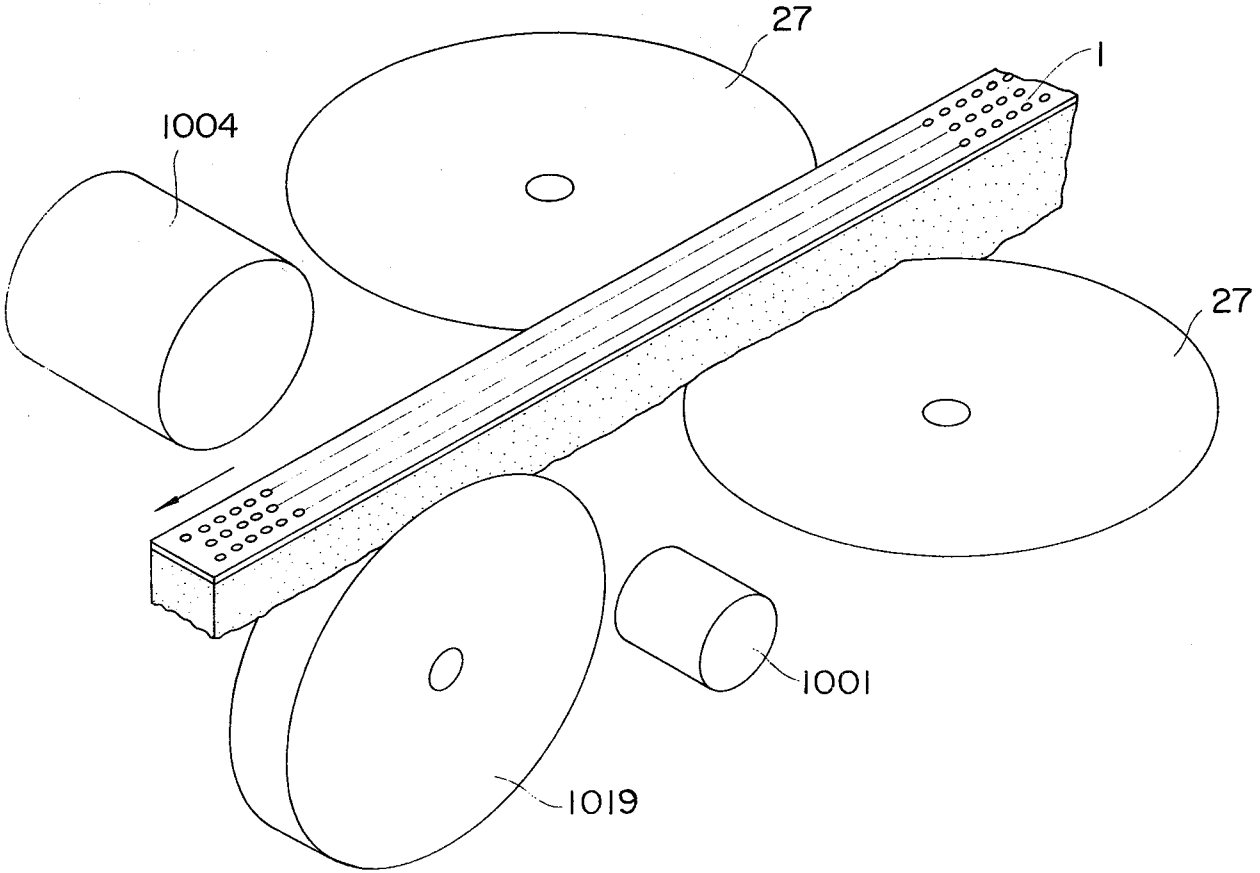
FIG. 10 is a diagrammatical view illustrating one form of a compression means.

In order to overcome the above disadvantage, there is provided another embodiment as shown in FIG. 10. A compression means 1019 is provided below the conveyor band 1 and the cut tobacco is compressed between the conveyor 1 and the compression means 1019 in such a manner that there is no space left in the filler. The distance between the conveyor and the compression means may be determined according to a practical use of the machine. The cut tobacco thus compressed is irradiated with beta rays. The leak of the beta rays is eliminated and the beta rays which will enter the ion chamber are limited only to those that have penetrated the cut tobacco. Thus, the correct and precise measurement of the amount of the tobacco filler can be achieved with a remarkable improvement in the response rate.

Figure 9:
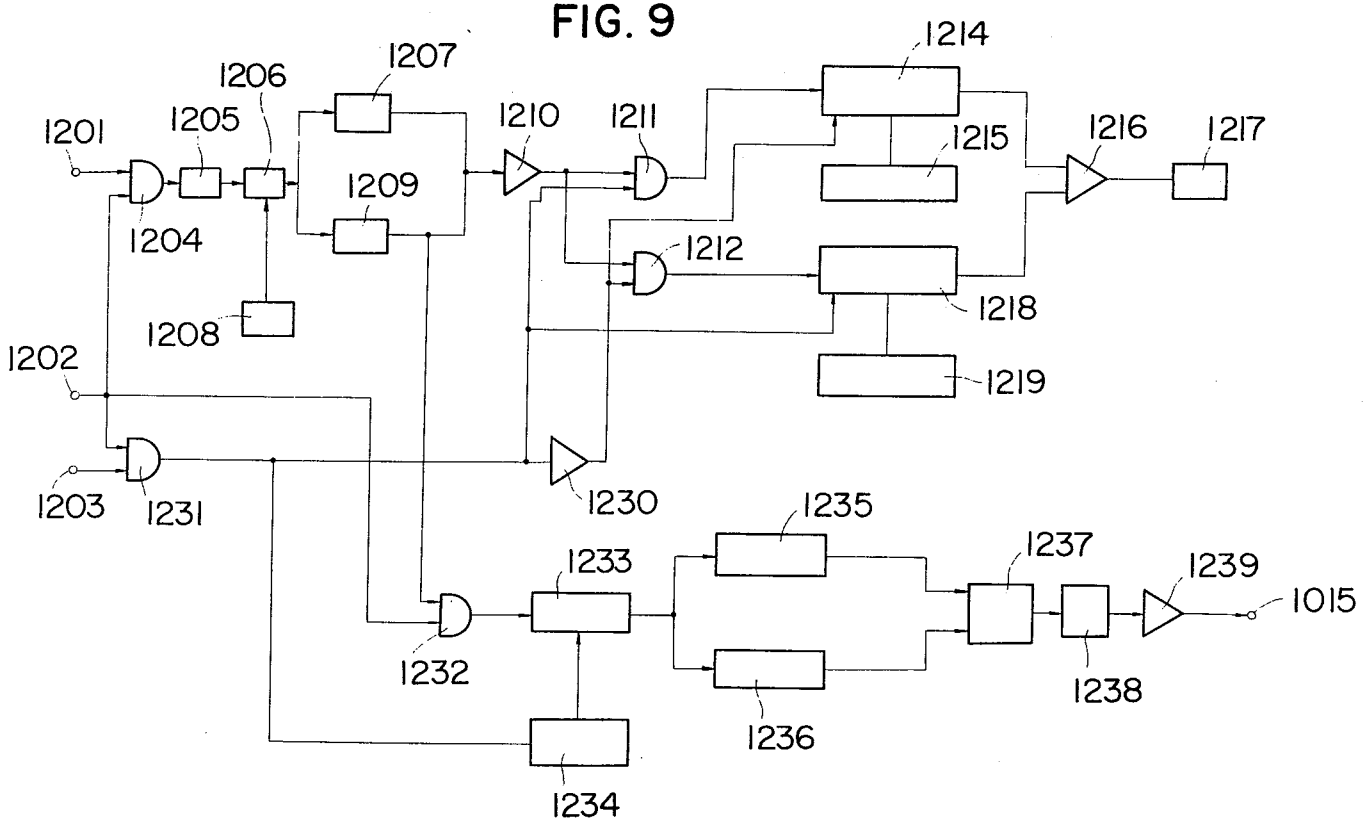

Now referring to FIG. 9 there is illustrated a circuit for regulating an amount per unit length of the tobacco filler. An output from the amplifier 1010 in FIG. 8 passes through a terminal 1201 and a gate 1204 and converted by a pulse width modulator 1205 into a pulse train having a pulse length corresponding to voltage value. Said gate 1204 is adapted to close by applying an appropriate voltage on a terminal 1202 when a cigarette maker wants to operate the circuit of FIG. 9. The pulse thus converted is counted by a counter 1206 which starts the count according to a pulse generated from a close 1208 every fixed time which is a little shorter than a period during which one cigarette is produced in a cigarette manufacturing machine. Accordingly the voltage applied to the terminal 1201 is converted into the pulse number to be counted by the counter 1206, and, therefore, the mass of one rod cigarette is substantially in proportion to the pulse number indicated by the counter 1206.

Now, the number to be counted by the counter 1206 when a rod cigarette having the maximum allowable mass per unit length is at a detecting position of the ion chamber 1004 is set in a comparator 1207, and the number to be counted by the counter 1206 when a rod cigarette havng the minimum allowable mass per unit length is at the detecting position of the ion chamber 1004 is set in a comparator 1209.

Under these conditions, when the counter 1206 indicates a certain number between the numbers set in the comparator 1207 and the comparator 1209, it shows that the cigarette is marketable, and an adder 1210 receives any signal from neither the comparator 1207 nor the comparator 1209. When the number indicated by the counter 1206 is out of the range, namely when the mass per unit length of the filler is smaller than the minimum value and larger than the maximum value, a corresponding signal is fed to the adder 1210 from the comparator 1209 and the comparator 1207, respectively, and a corresponding signal from the adder 1210 reaches a gate 1211 and a gate 1212, respectively.

While, a terminal 1203 is adapted to receive a signal from the cigarette manufacturing machine in such a manner that when one cigarette is produced, a voltage is applied; when the next one is produced, no voltage is applied; when the further next one is produced, a voltage is applied; and so on. A gate 1231 is adapted to open when voltage is applied to both the terminal 1203 and the aforementioned terminal 1202. The signal from the gate 1231 reaches the gate 1211 and the signal from a reversing switch 1230 reaches the gate 1212. The reversing switch 1230 is closed when the gate 1231 is opened, and vice versa. The gate 1211 opens when both the adder 1210 and the gate 1231 deliver signals to it, and the gate 1212 opens when the adder 1210 delivers a signal and the gate 1231 does not.

A shift register 1214 has the same number of memories as the number of the signals given from the reversing switch 1230 while a voltage is applied to the terminal 1203 and the cigarette at the detecting position in the ion chamber 1004 reaches a classifying means where cigarettes are classified into a superior group and an inferior group. A shift register 1218 has the same number of memories as the number of signals given from the adder 1210 while a voltage is not applied to the terminal and a cigarette in the ion chamber 1004 reaches the classifying means. The shift register 1214 transfers the memory one by one whenever the reversing switch 1230 makes a signal, and the shift register 1218 transfers the memory one by one whenever the gate 1231 makes a signal. The signals from the shift register 1214 are added to those from the shift register 1218, at an adder 1216 and an electro-magnetic valve 1217 in the classifying means is actuated by the signal from the adder 1216. With such arrangements as explained, all the cigarettes can be classified according to the mass.

Indicating lamps 1215 and 1219 indicate the state of the shift registers 1214 and 1218, respectively, from which an operator of the cigarette manufacturing machine can know whether they function normally or not.

A gate 1232 closes when the comparator 1209 makes a signal, namely, when a mass per unit length of the filler is below the minimum limit and a signal is applied on the terminal 1202. While, a signal is transmitted to a counter 1233 from a counter 1234 whenever the counter 1234 counts up every predetermined number of closing of the gate 1231. The figure of the counter 1233 is put back to zero whenever the counter 1234 delivers a signal to it, and the counter 1233 counts how many times the gate 1232 closes until the next signal comes from the counter 1234. If the counted number is above the value set in a comparator 1235, the number counted by an up-down counter 1237 is decreased; and if the counted number is below the value set in a comparator 1236, the number in the up-down counter 1237 is increased. The number counted by the up-down counter 1237 is converted into a corresponding voltage through a digital-analog convertor 1238, and is then amplified in an amplifier 1239, and the voltage is applied to the amplifier 1013 through the terminal 1015 in FIG. 8.

Assume now that the number of the cigarettes each having less mass of the filler than the minimum value is above the predetermined number, then the number counted by the counter 1233 at every signal from the counter 1234 is more than the value set in the comparator 1235, the count number in the up-down counter 1237 is decreased, an output from the digital-analog convertor 1238 goes negative, a potential at an amplifier 1239 is negative-going, a potential at the amplifier 1011 goes positive, an output from the amplifier 1013 gradually goes negative and an output from the main amplifier 513 goes positive. Accordingly, the electrohydraulic servo valve 212 opens, the discs 27 are lowered to increase the mass per unit length of the filler, to wit, the mass per one piece of cigarette, whereby the rate of the cigarettes having the mass below the minimum limit is decreased. By contraries, when the number of cigarettes each having less mass of the filler than the minimum value is below the predetermined number, the number counted by the counter 1233 at every signal from the counter 1234 is less than the value set in the comparator 1236, the count number in the up-down counter 1237 is increased, an output from the digital-analog convertor goes positive, a potential at the amplifier 1239 goes positive, a potential at the amplifier 1011 goes negative, an output from the amplifier 1013 gradually goes positive, and an output from the main amplifier 513 goes negative. Accordingly, the discs 27 is raised through the operation of the electrohydraulic servo valve 212 to decrease the mass per unit length of the tobacco filler, to wit, the mass per one piece of cigarette, whereby the rate of the cigarette having the mass below the minimum limit is increased. There are provided such arrangements as discussed above so as to always keep a constant rate of inferior cigarettes to be removed.

As detailedly explained above, in the present invention, the tobacco is irradiated with radiant rays and the amount of the radiant rays which have penetrated the tobacco is converted into an electrical signal to detect the amount of the tobacco. At the same time the reciprocating piston is actuated by the fluid pressure from the oil pressure pump through the fluid pressure distributing means to impart the rocking movement to the trimming discs. The operation of the fluid pressure distributing means forms the electrohydraulic servo mechanism in which the servo valve receives the signal converted from the amount of radiant rays and the negative feed back signal from the displacement of the trimming discs through the differential transformer. Therefore, the variations in tobacco density are rapidly detected, and the height or level of the trimming discs for trimming the tobacco filler can be rapidly and surely corrected through the electrohydraulic servo mechanism with the oil pressure system of high response speed.

Further, in the present invention, the pressure of the air which has traversingly penetrated the tobacco filler beneath the air permeable conveyer band is converted into an electrical signal through the semiconductive pressure transducer thereby also to control the height of the trimming discs. Thus, there is provided such electrohydraulic servo mechanism that the signal from the air pressure, the signal fedback from the displacement of the trimming discs and the signal from the radiant ray permeation jointly and directly act upon one fluid pressure distributing means through one control circuit. Therefore, according to the present invention correction of the level of the trimming discs can be accomplished at a high speed in a more stable manner, and the uniformity in the amount of the tobacco filler can be well improved to satisfy consumers.

Still further, in accordance with the present invention, the tobacco to be irradiated with radiant rays is not necessarily limited to the wrapped rod cigarettes, namely, cut tobacco may be irradiated to detect the amount of the tobacco. Accordingly, the position at which the amount of the tobacco filler is detected and the position of the trimming discs can be optionally fixed, for example, they may be very close to each other, whereby almost all possible disturbance between the detecting and the trimming operation can be removed, and the correction or control of the trimming means can be carried out at extremely high rate while eliminating the waste of time.

Thus, in the present invention the interrelation between a characteristic of the tobacco filler and the amount of the tobacco filler is utilized to detect the amount of the filler, and the detection can be done at any desired position along the conveyor. Further in the present invention, the apparatus of simple construction can be operated by one control mechanism thereby to remarkably improve the response speed and the uniformity in the amount of the tobacco filler to attain the desired objects.

While a preferred embodiment of the invention has been illustrated and described in detail, it should be noted that the invention is not limited thereto and thereby.

What is claimed is:

1. An apparatus for controlling an amount of a tobacco filler as it is conveyed by a conveyor in a cigarette manufacturing machine, comprising detecting means for detecting an amount of a tobacco filler and transmitting an electrical signal corresponding to the amount detected, integrating means for integrating said electrical signal, an electrical servo valve operative in response to said integrated electrical signal from said integratng means, a hydraulic piston means actuated by said electrical servo valve, a trimming hydraulic means coupled to said piston means and moving in response to the movement of said piston means and a negative feed back means for feeding back an electrical signal corresponding to a displacement of the trimming means to the electrical servo valve to control the movement of the piston means.

2. An apparatus as claimed in claim 1, wherein said detecting means for detecting the amount of the tobacco filler and transmitting the signal comprises an irradiation means for applying radiant rays to the filler at a position along the length of the filler, in a direction traversing the lengthwise direction of the filler, and a means facing to said irradiation means through the filler to detect the amount of the filler through measurement of an amount of the radiant rays penetrated the filler.

3. An apparatus as claimed in claim 1, wherein the trimming means is a pair of discs arranged adjacently to each other and adapted to rotate in opposite directions.

4. An apparatus as claimed in claim 1, wherein the negative feed back means comprises a differential transformer.

5. An apparatus as claimed in claim 1, which further comprises a small chamber near the trimming means, said chamber havng an opening adjacent the conveyor at the side opposite to that on which the tobacco filler is conveyed, said conveyer having an air transmitting porous belt; a means to pass air through the filler into the chamber in a direction traversing the lengthwise direction of the filler at another position different from the irradiation position along the length of the filler; and a means attached to said small chamber for converting an air pressure in the small chamber into an electrical signal, said signal being applied to the electrical servo valve thereby to regulate the operation of the trimming means.

6. An apparatus as claimed in claim 5 comprising a compression means provided at the irradiation position to compress the tobacco filler between the conveyor means and said compression means, and wherein the radiant rays are applied to said compressed portion of the tobacco filler.

7. An apparatus as claimed in claim 5, wherein said means for converting the air pressure into the electrical signal is a semiconductive pressure transducer.

8. An apparatus as claimed in claim 6 comprising a compression means provided at the irradiation position to compress the tobacco filler between the conveyor means and said compression means, and wherein the radiant rays are applied to said compressed portion of the tobacco filler.

* * * * *